US011705665B2

(12) United States Patent
Masuda et al.

(10) Patent No.: US 11,705,665 B2
(45) Date of Patent: Jul. 18, 2023

(54) CONNECTOR

(71) Applicant: Yazaki Corporation, Tokyo (JP)

(72) Inventors: Satoki Masuda, Shizuoka (JP); Takeo Ida, Shizuoka (JP); Yoshinao Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 129 days.

(21) Appl. No.: 17/455,310

(22) Filed: Nov. 17, 2021

(65) Prior Publication Data

US 2022/0158384 A1 May 19, 2022

(30) Foreign Application Priority Data

Nov. 18, 2020 (JP) ..... 2020-191359

(51) Int. Cl.
*H01R 13/42* (2006.01)
*H01R 13/52* (2006.01)

(52) U.S. Cl.
CPC ..... *H01R 13/5219* (2013.01); *H01R 13/42* (2013.01)

(58) Field of Classification Search
CPC ... H01R 13/521; H01R 13/5219; H01R 13/42
See application file for complete search history.

(56) References Cited

U.S. PATENT DOCUMENTS

| | | | | |
|---|---|---|---|---|
| 9,059,534 | B2 * | 6/2015 | Endo | H01R 13/5205 |
| 9,281,627 | B2 * | 3/2016 | Fujiwara | H01R 13/6581 |
| 10,468,811 | B2 * | 11/2019 | Endo | H01R 13/502 |
| 11,456,560 | B2 * | 9/2022 | Masuda | H01R 13/5202 |
| 2012/0270444 | A1 * | 10/2012 | Kawamura | H01R 13/5202 439/607.44 |
| 2022/0052473 | A1 * | 2/2022 | Masuda | H01R 13/5202 |
| 2022/0069511 | A1 * | 3/2022 | Masuda | H01R 13/5202 |

FOREIGN PATENT DOCUMENTS

JP 2009-104837 A 5/2009

* cited by examiner

*Primary Examiner* — Tho D Ta
(74) *Attorney, Agent, or Firm* — Sughrue Mion, PLLC

(57) ABSTRACT

A connector includes a terminal fitting, a housing, a front holder to which an engagement part of the housing is inserted along an inserting direction of the engagement part with respect to a counterpart engagement part, and a water-stopping member with an annular shape that closes an annular space between a projection part from the front holder at an outer peripheral wall surface of the engagement part and an inner peripheral wall surface of the counterpart engagement part. The front holder includes a retained part that projects toward the outer peripheral wall surface of the engagement part. The water-stopping member includes a retained part that projects inward relative to an inner peripheral surface. The engagement part includes a communication retaining part where a first retaining part and a second retaining part are provided in a communicating state.

4 Claims, 8 Drawing Sheets

CONNECTOR

CROSS-REFERENCE TO RELATED APPLICATION(S)

The present application claims priority to and incorporates by reference the entire contents of Japanese Patent Application No. 2020-191359 filed in Japan on Nov. 18, 2020.

BACKGROUND OF THE INVENTION

1. Field of the Invention

The present invention relates to a connector.

2. Description of the Related Art

As for a connector, while an engagement part of a housing is inserted into and engaged with the inside of a counterpart engagement part, a terminal fitting housed in the housing is electrically connected to the counterpart terminal fitting. Conventionally, the connector includes a water-stopping member that closes an annular space between an outer peripheral wall surface of the engagement part of the housing and an inner peripheral wall surface of the counterpart engagement part, and a front holder that keeps the terminal fitting held in the housing. The water-stopping member and the front holder are assembled to the outer peripheral wall surface of the engagement part of the housing, and are held by this housing through the respective holding structures while these components remain at the assembling position. This type of connector is disclosed in Japanese Patent Application Laid-open No. 2009-104837, for example.

Thus, in the connector, a plurality of components are assembled to the engagement part of the housing. Therefore, for this connector, the enlargement of the body due to the engagement part and the components assembled to the engagement part needs to be suppressed.

SUMMARY OF THE INVENTION

In view of this, it is an object of the present invention to provide a connector that can be prevented from enlargement of its body.

In order to achieve the above mentioned object, a connector according to one aspect of the present invention includes a terminal fitting attached to a terminal of an electric wire; a housing that houses the terminal fitting on an inner side and includes an engagement part that is inserted into and engaged with an inside of a counterpart engagement part having an inner peripheral wall surface; a front holder to which the engagement part is inserted along an inserting direction of the engagement part with respect to the counterpart engagement part, and that keeps the terminal fitting held in the housing; and a water-stopping member with an annular shape, an inner peripheral surface side of the water-stopping member being assembled to a projection part from the front holder at an outer peripheral wall surface of the engagement part, the water-stopping member closing an annular space between the projection part of the outer peripheral wall surface and the inner peripheral wall surface of the counterpart engagement part, wherein the front holder includes a retained part that projects toward the outer peripheral wall surface of the engagement part, the water-stopping member includes a retained part that projects inward relative to the inner peripheral surface, and the engagement part includes a communication retaining part where a first retaining part to which the retained part of the front holder is inserted and that retains movement of the retained part to the inserting direction, and a second retaining part to which the retained part of the water-stopping member is inserted and that retains movement of the retained part in a circumferential direction of the water-stopping member are provided in a communicating state.

According to another aspect of the present invention, in the connector, it is preferable that the communication retaining part is a groove or a penetration hole formed in the outer peripheral wall surface of the engagement part.

According to still another aspect of the present invention, in the connector, it is preferable that combinations of the retained part of the front holder, the retained part of the water-stopping member, and the communication retaining part are provided at a plurality of places along the circumferential direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a connector according to the present invention is hereinafter described in detail with reference to the drawings. Note that the present invention is not limited by this embodiment.

Embodiment

One embodiment of the connector according to the present invention is described with reference to FIG. 1 to FIG. 8.

Figure 1:
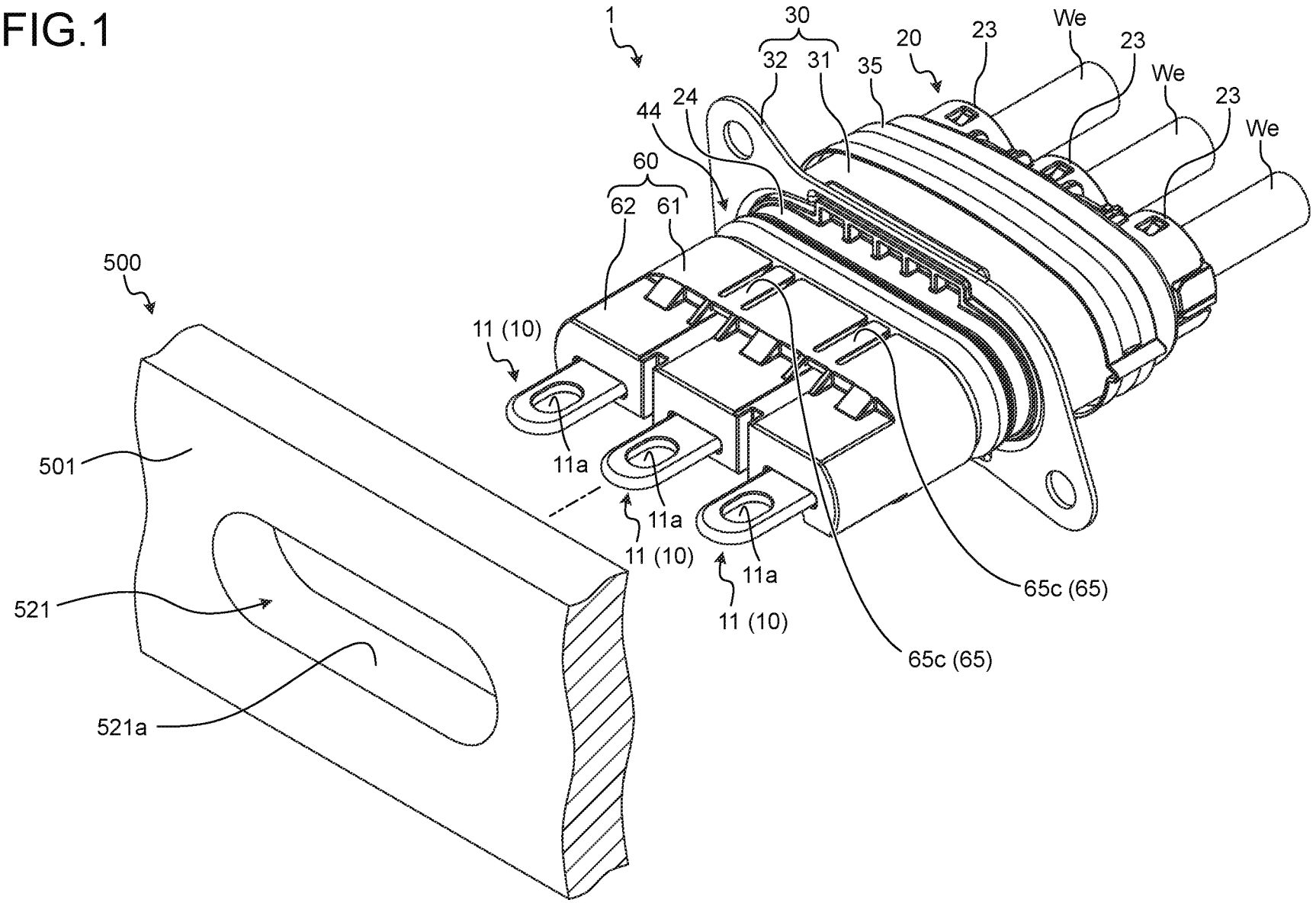
FIG. 1 is a perspective view illustrating a connector according to an embodiment.

In FIG. 1 to FIG. 7, reference symbol 1 denotes a connector according to the present embodiment. When this connector 1 is inserted into and engaged with a counterpart engagement part 521 with a hole shape including an inner peripheral wall surface 521*a*, the connector 1 is electrically connected to a counterpart terminal fitting (not illustrated) (FIG. 1). The connector 1 is inserted into and removed from the counterpart engagement part 521 with the hole shape along a hole axis direction of this counterpart engagement part 521. The counterpart engagement part 521 is formed so that a cross-section thereof orthogonal to the hole axis direction has a circular shape or an elliptical shape, for example. Note that the counterpart engagement part 521 may be formed in a tubular shape and may have an engagement part 21 inserted into and engaged with an internal space of the tubular shape.

For example, by the electric connection of this connector 1 to the counterpart terminal fitting of a counterpart device 500, this counterpart device 500 and a device at the destination of an electric wire We (not illustrated) can be electrically connected (FIG. 1). The counterpart device 500 includes a casing 501 made of metal, and uses a penetration hole formed in a wall body of this casing 501 as the counterpart engagement part 521. This counterpart device 500 includes a terminal base or a counterpart connector (not illustrated) inside the casing 501. The counterpart terminal fitting is provided in the terminal base or the counterpart connector. Therefore, when the connector 1 is inserted into and engaged with the counterpart engagement part 521, the connector 1 is electrically connected to the counterpart terminal fitting of the terminal base or the counterpart connector inside the casing 501.

The inserting direction described hereinafter indicates the inserting direction of the connector 1 with respect to the counterpart engagement part 521 unless otherwise stated. The removing direction described hereinafter indicates the removing direction of the connector 1 with respect to the counterpart engagement part 521 unless otherwise stated. Moreover, the inserting and removing direction described hereinafter indicates the inserting and removing direction of the connector 1 with respect to the counterpart engagement part 521 unless otherwise stated.

This connector 1 includes a terminal fitting 10, a housing 20, and a shield shell 30 (FIG. 1 to FIG. 7).

Figure 4:
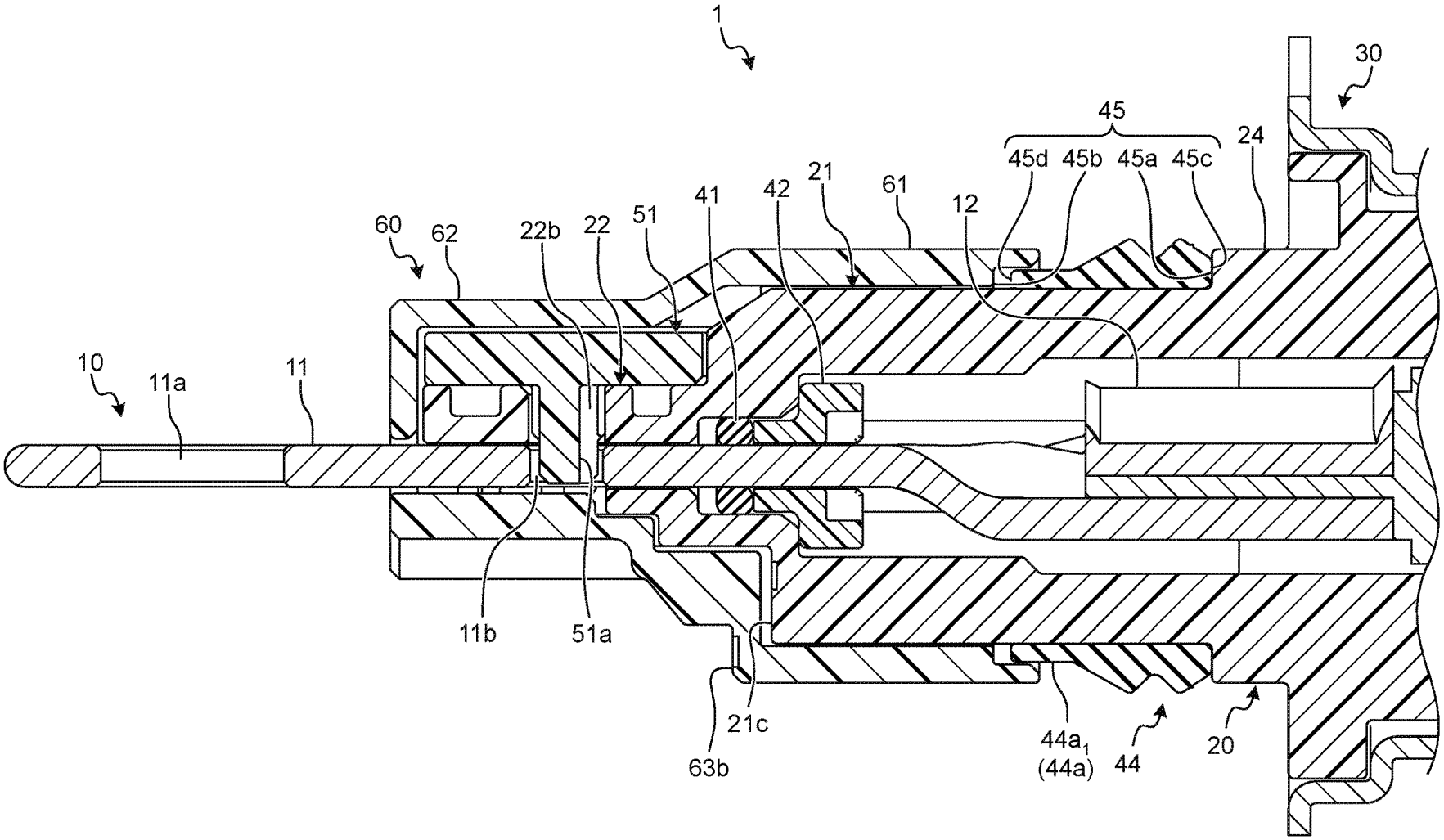
FIG. 4 is a cross-sectional view taken along line X2-X2 in FIG. 2.
Figure 5:
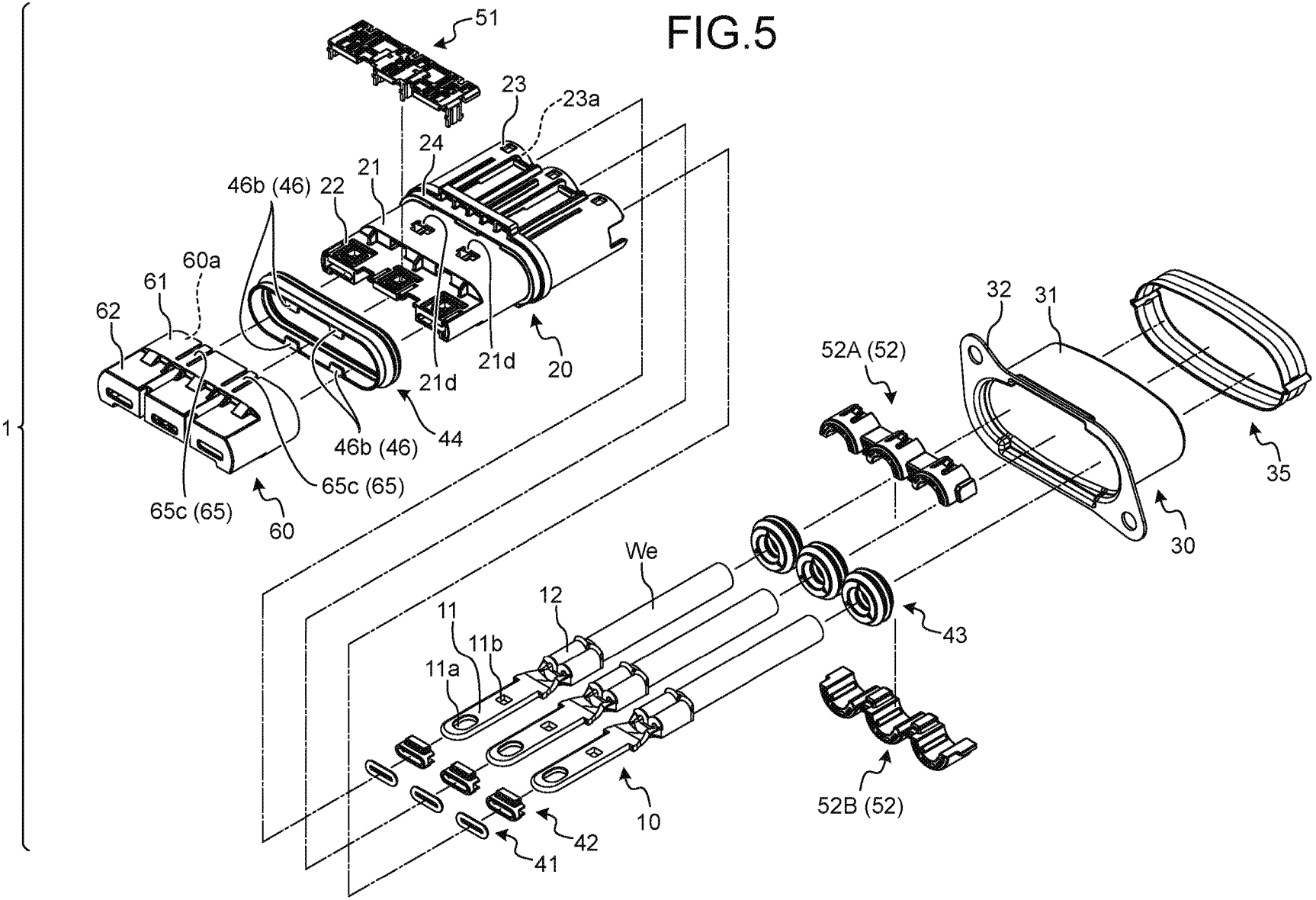
FIG. 5 is an exploded perspective view illustrating the connector according to the embodiment.

The terminal fitting 10 is molded of a conductive material such as metal. For example, this terminal fitting 10 is molded into a predetermined shape by press-molding, such as bending processing or cutting processing, of a metal plate that is a base material. This terminal fitting 10 is attached to a terminal of this electric wire We for the electric connection to the electric wire We. In addition, this terminal fitting 10 is electrically connected to the counterpart terminal fitting. Therefore, this terminal fitting 10 includes a terminal connection part 11 that physically and electrically connects to the counterpart terminal fitting, and an electric wire connection part 12 that physically and electrically connects to the terminal of the electric wire We (FIG. 4 and FIG. 5).

The terminal connection part 11 illustrated here is formed to have a piece body shape (FIG. 1, and FIG. 4 to FIG. 7). In this terminal connection part 11, a penetration hole 11*a* is formed. When the terminal connection part 11 is fixed to the counterpart terminal fitting with a screw, for example, through the penetration hole 11*a*, the terminal connection part 11 physically and electrically connects to this counterpart terminal fitting. Note that the connection mode between the terminal fitting 10 and the counterpart terminal fitting is not necessarily such a screw fixing structure. For example, the terminal fitting 10 and the counterpart terminal fitting have such shapes that can be engaged with and connected to each other, and one of them may be molded into a female terminal shape and the other may be molded into a male terminal shape.

The electric wire connection part 12 is physically and electrically connected to the electric wire We by, for example, compressing or welding to a core wire of the terminal of the electric wire We. The electric wire connection part 12 illustrated here has two barrel pieces thereof connected to the uncovered core wire by caulking, so that the barrel pieces are compressed on the core wire.

The terminal fitting 10 in this example is molded as a straight shape where the terminal connection part 11 and the electric wire connection part 12 are disposed on a straight line. Therefore, the electric wire We is drawn from the electric wire connection part 12 in an extending direction of the terminal fitting 10 along the straight line. Alternatively, this terminal fitting 10 may have the terminal connection part 11 and the electric wire connection part 12 arranged intersecting with each other, for example orthogonal to each other.

The connector 1 illustrated here includes three pairs of terminal fittings 10 and electric wires We.

The housing 20 is molded of an insulating material such as synthetic resin. This housing 20 internally houses the terminal fitting 10 and the electric wire We. In this housing 20, the terminal fitting 10 is held in the housed state and the electric wire We thereof is drawn from the inside to the outside.

This housing 20 internally houses the terminal fitting 10 and includes the engagement part 21 that is inserted into and engaged with the inside of the counterpart engagement part 521 (FIG. 3 to FIG. 8). This engagement part 21 is inserted into and engaged with the inside of the counterpart engagement part 521 along the inserting direction, and is removed from the inside of the counterpart engagement part 521 along the removing direction that is opposite to the inserting direction. This engagement part 21 has a tubular shape the tube axis direction of which coincides with the inserting and removing direction (inserting direction, inserting and removing direction) with respect to the counterpart engagement part 521. Therefore, the inserting and removing direction may hereinafter be referred to as the tube axis direction. The engagement part 21 illustrated here is formed so that the cross-section orthogonal to the tube axis has an elliptical tubular shape, and along the longitudinal direction of the ellipse, the three terminal fittings 10 are arranged in parallel. Inside the engagement part 21 illustrated here, the electric wire connection part 12 side of the terminal connection part 11 and the terminal connection part 11 side of the electric wire connection part 12 are housed. Inside the engagement part 21, a partition wall (not illustrated) is provided between the adjacent terminal fittings 10.

Figure 3:
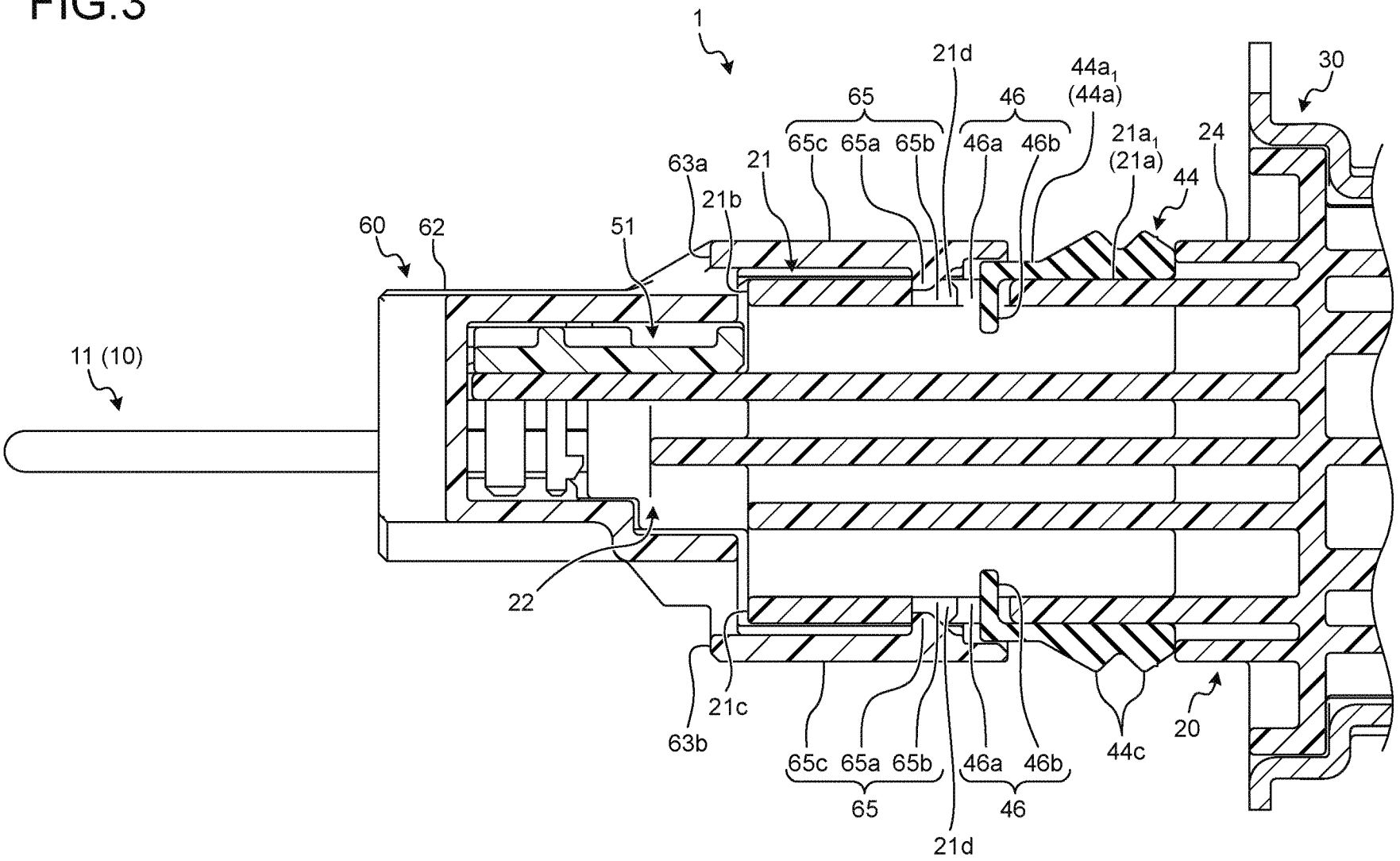
FIG. 3 is a cross-sectional view taken along line X1-X1 in FIG. 2.
Figure 8:
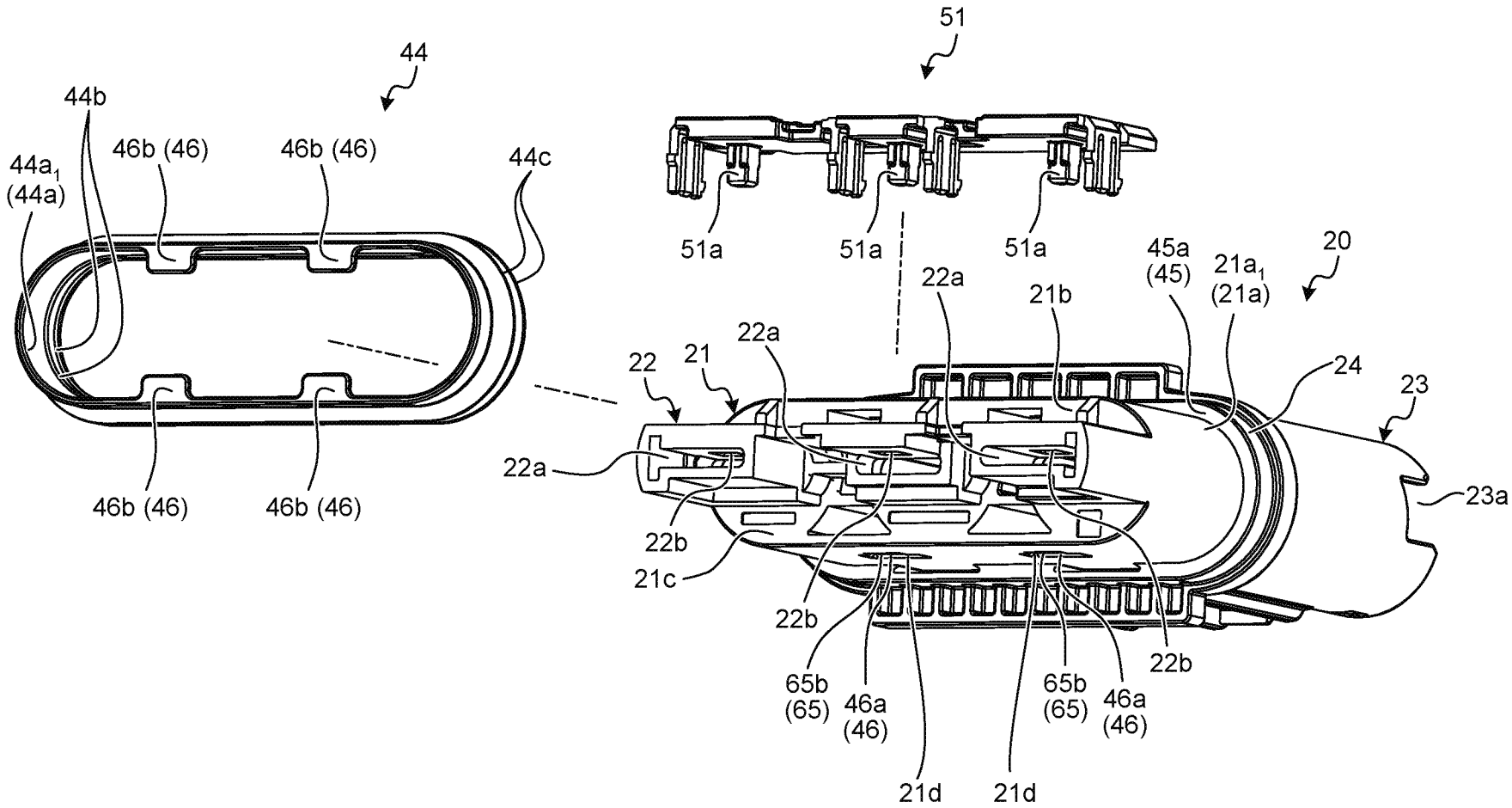
FIG. 8 is an exploded perspective view in which a housing, the water-stopping member, and a retaining member are viewed from different angles.

The engagement part 21 includes end surfaces 21*b* and 21*c* at end parts that are on the inserting direction side and that are on an outer peripheral wall surface 21*a* side in the orthogonal direction with respect to the inserting direction and the arrangement direction of the three terminal fittings 10 (FIG. 3 and FIG. 8). Each of the end surfaces 21*b* and 21*c* is formed as an orthogonal plane with respect to the inserting and removing direction.

This housing 20 includes a projection part 22 projecting to the inserting direction over the end surfaces 21*b* and 21*c* of the engagement part 21 between the end surfaces 21*b* and 21*c* (FIG. 3 to FIG. 8). Inside the projection part 22, the terminal fitting 10 is housed. The projection part 22 may be provided for each terminal fitting 10, or may be formed as one protrusion to house all the terminal fittings 10. The projection part 22 illustrated here is to house all the terminal fittings 10, and includes a housing room 22*a* for each terminal fitting 10 (FIG. 8). The housing room 22*a* houses the terminal connection part 11 internally and makes the end part of the terminal connection part 11 on the penetration hole 11*a* side project from the inside to the outside.

In this connector 1, an annular water-stopping member (so-called O-ring) 41 (FIG. 4 and FIG. 5) is assembled to the terminal connection part 11, and by this water-stopping member 41, an annular space between the terminal connection part 11 and an inner peripheral surface of the housing room 22*a* is closed. In this terminal connection part 11, an annular holding member 42 (FIG. 4 and FIG. 5) is assembled, and by this holding member 42, the water-stopping member 41 is held.

The connector 1 includes a retaining member 51 that is assembled to the projection part 22 and retains the terminal fitting 10 at this projection part 22 while the terminal fitting 10 remains in the housed state (FIG. 3 to FIG. 8). The retaining member 51 includes a protrusion 51*a* for each terminal fitting 10 (FIG. 4 and FIG. 8). When the protrusion 51*a* is inserted into a penetration hole 11*b* corresponding to the retained part formed in the terminal connection part 11, the relative movement of the terminal connection part 11 with respect to the projection part 22 is retained (FIG. 4 and FIG. 5). The projection part 22 includes a penetration hole 22*b* formed for each protrusion 51*a* (FIG. 4 and FIG. 8).

Two of the three penetration holes 22*b* illustrated here, which are at opposite ends, are penetration holes that communicate between the housing rooms 22*a* at the opposite ends and the outside, and when the retaining member 51 is assembled to the projection part 22, the protrusions 51*a* at the opposite ends that are inserted from the outside are allowed to enter the housing rooms 22*a*. The two protrusions 51*a* are inserted into the penetration holes 11*b* of the terminal connection parts 11 in the housing rooms 22*a*. The other penetration hole 22*b* at the center is inserted into the penetration hole 11*b* of the terminal connection part 11 projecting from the central housing room 22*a*.

While the engagement part 21 is inserted into and engaged with the inside of the counterpart engagement part 521, a part of the housing 20 on the removing direction side relative to the engagement part 21 projects from the counterpart engagement part 521. This housing 20 includes an electric wire housing part 23 with a tubular shape for housing the electric wire We internally, and the electric wire housing part 23 corresponds to the projection part from the counterpart engagement part 521 on the removing direction side (FIG. 5 to FIG. 8). The electric wire housing part 23 illustrated here is formed in a cylindrical shape, and is provided for each electric wire We. The respective electric wire housing parts 23 are arranged in the direction where the three terminal fittings are arranged. This housing 20 includes a tubular part 24 between the engagement part 21 and each electric wire housing part 23. The tubular part 24 has the same axis as the tube axis of the engagement part 21 and is provided outside the outer peripheral wall surface 21*a* of the engagement part 21 (FIG. 1, FIG. 3 to FIG. 5, and FIG. 8). The tubular part 24 illustrated here is formed so that the cross-section orthogonal to the tube axis has an elliptical tubular shape.

In this housing 20, the electric wire We with the terminal fitting 10 is inserted from an opening 23*a* of the electric wire housing part 23 (FIG. 5 to FIG. 8). Therefore, the electric wire We is drawn outward from the opening 23*a*. Here, between the electric wire housing part 23 and the electric wire We, an annular space is formed. In view of this, in this connector 1, the electric wire We is inserted first through an annular water-stopping member (so-called rubber stopper) 43 (FIG. 5), and then, by inserting the water-stopping member 43 together with the electric wire We into the electric wire housing part 23, the annular space between the electric wire housing part 23 and the electric wire We is closed.

Figure 6:
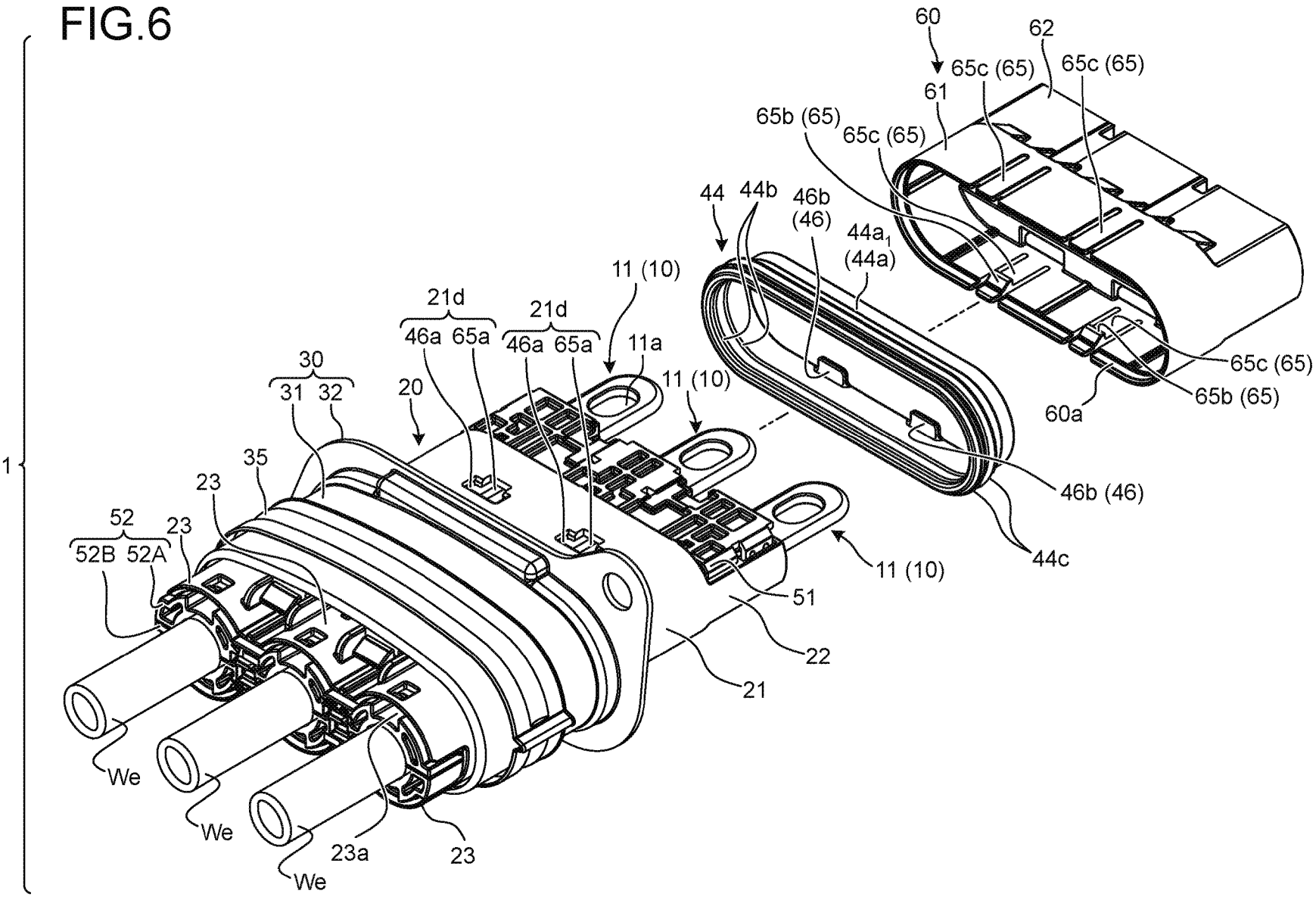
FIG. 6 is an exploded perspective view in which the connector before a water-stopping member and a front holder are assembled is viewed from a different angle.
Figure 7:
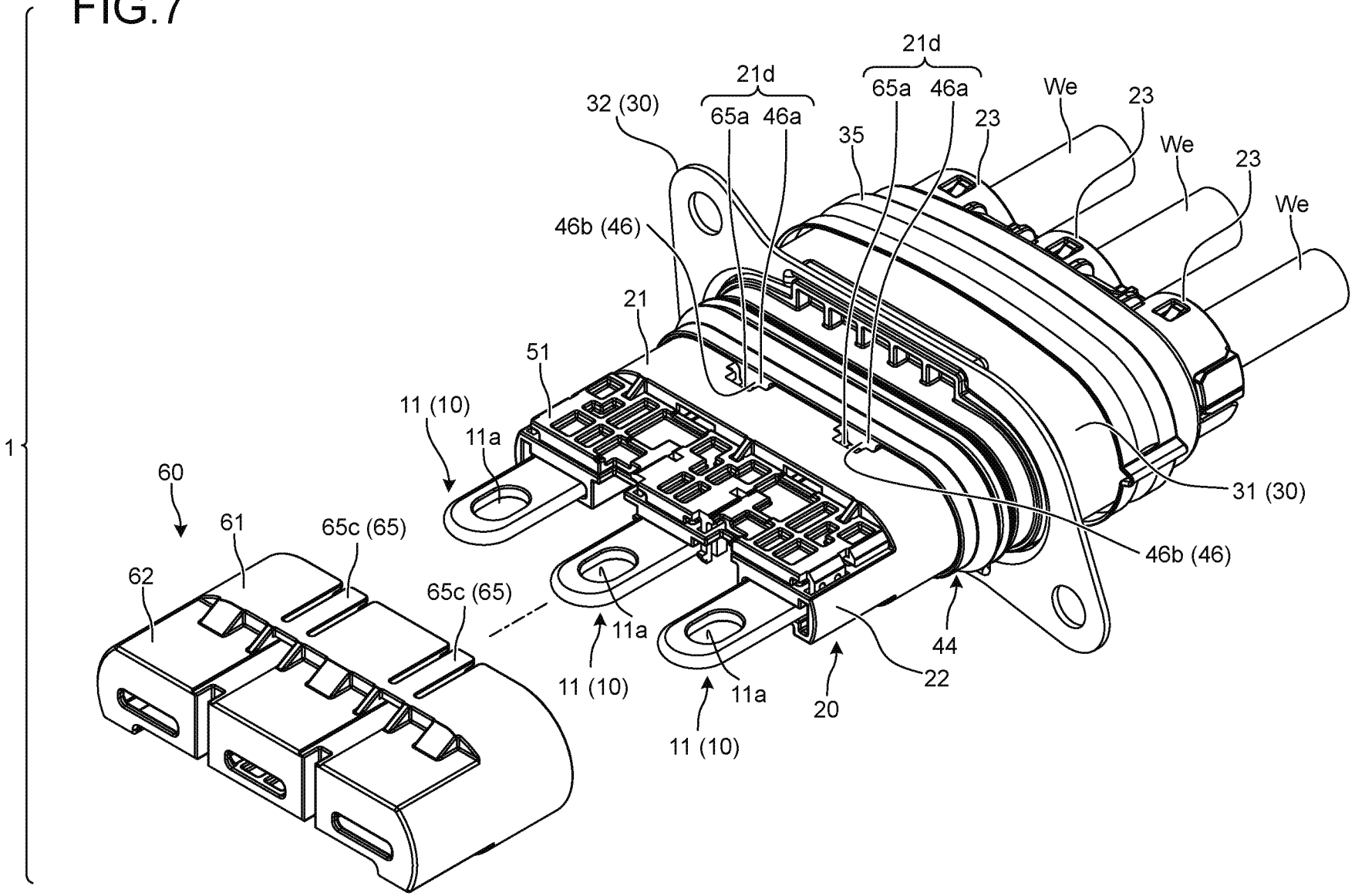
FIG. 7 is an exploded perspective view of the connector before the front holder is assembled.

In this connector 1, between the opening 23*a* of the electric wire housing part 23 and the water-stopping member 43, a rear holder 52 for holding the electric wire We while suppressing the bending of the electric wire We is assembled (FIG. 5 to FIG. 7). The rear holder 52 in this example has a two-split structure of a first holder member 52A and a second holder member 52B, and the first holder member 52A and the second holder member 52B have the respective electric wires We held therebetween. The respective electric wires We are drawn outward from the openings 23*a* through the rear holder 52. Although not described in detail, the rear holder 52 is held by the respective electric wire housing parts 23 in a manner that a claw part provided to each of the first holder member 52A and the second holder member 52B is inserted into a penetration hole of each electric wire housing part 23. The first holder member 52A and the second holder member 52B are molded of an insulating material such as synthetic resin, for example.

The shield shell 30 suppresses the entry of noise from the outside to the internal electric wire We by covering the electric wire housing part 23 from the outside. Thus, this shield shell 30 is molded of a metal material (for example, aluminum or aluminum alloy).

This shield shell 30 includes a tubular part 31 that covers the electric wire housing part 23 from the outside and a flange part 32 that covers the electric wire housing part 23 side of the tubular part 24 from the outside (FIG. 1 and FIG. 5 to FIG. 7). The tubular part 31 is formed so that the cross-section thereof orthogonal to the tube axis has an elliptical tubular shape, and along the longitudinal direction of the ellipse, the three electric wire housing parts 23 are arranged in parallel. The flange part 32 has the same axis as the tube axis of the tubular part 31, and is formed to have a flat plate shape and an annular shape projecting outward over an outer peripheral surface of the tubular part 31. This flange part 32 is fixed to the casing 501 with a screw in a manner that a plane of the flange part 32 is in surface contact with a plane of the casing 501.

This connector 1 includes a braid (not illustrated) covering the outer peripheral surface of the tubular part 31 and the electric wire We drawn out of the opening 23*a*. The braid is a member formed of a metal material with a tubular shape and braided into a mesh shape. The braid suppresses the entry of noise to the electric wire We drawn out of the opening 23*a*. This braid is in pressure contact with the outer peripheral surface of the tubular part 31 using a tubular connection member 35 (FIG. 1 and FIG. 5 to FIG. 7).

The connector 1 includes a front holder 60 to which the projection part 22 and the engagement part 21 in the housing 20 are inserted inward together with the retaining member 51 (FIG. 1 to FIG. 7). Inside this front holder 60, the engagement part 21, the projection part 22, and the retaining member 51 are inserted from an insertion port 60*a* (FIG. 5 and FIG. 6) along the inserting direction. This front holder 60 is to keep the terminal fitting 10, which is housed together with the engagement part 21 and the like, in the housed state in the housing 20, and prevents the retaining member 51 from being detached from the projection part 22. Therefore, this front holder 60 is molded of an insulating material such as synthetic resin.

Figure 2:
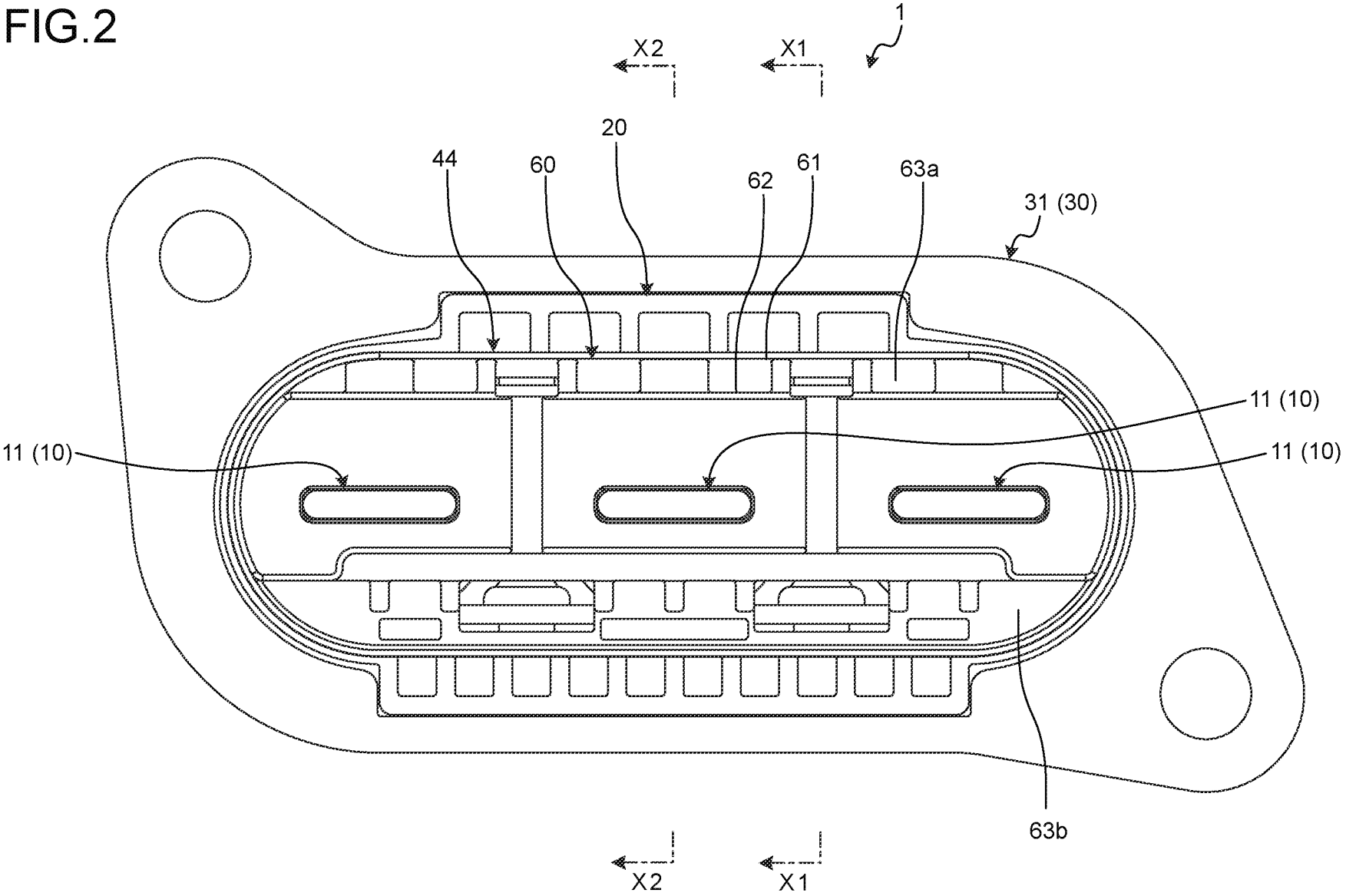
FIG. 2 is a plan view in which the connector according to the embodiment is viewed in a removing direction.

This front holder 60 includes a tubular part 61 to which the engagement part 21 is inserted (hereinafter referred to as "first tubular part"), and a tubular part 62 to which the projection part 22 is inserted together with the retaining member 51 (hereinafter referred to as "second tubular part") (FIG. 1 to FIG. 7). The front holder 60 moreover includes opposing wall parts 63*a* and 63*b* that are provided at one end of the first tubular part 61 on the inserting direction side and are disposed to face each other on the inserting direction side with respect to the end surfaces 21*b* and 21*c* of the engagement part 21 (FIG. 2 and FIG. 3). Here, the end surface 21*b* and the opposing wall part 63*a* are disposed to face each other and the end surface 21*c* and the opposing wall part 63*b* are disposed to face each other.

The first tubular part 61 has the same axis as the tube axis of the engagement part 21, and is formed so that the cross-section orthogonal to the tube axis has an elliptical tubular shape. By a holding mechanism 65 provided between the first tubular part 61 and the engagement part 21, the engagement part 21 holds the front holder 60 (FIG. 3, FIG. 6, and FIG. 7). In the holding mechanism 65 illustrated here, a retaining part 65*a* provided to the outer peripheral wall surface 21*a* of the engagement part 21 and a retained part 65*b* provided to the first tubular part 61 are disposed so as to be retained together in the range of the allowable relative movement quantity in design in the inserting and removing direction. Thus, this holding mechanism 65 retains the relative movement between the engagement part 21 and the first tubular part 61 in the inserting and removing direction in the range of the allowable relative movement quantity, and causes the engagement part 21 to hold the front holder 60.

This holding mechanism 65 causes the engagement part 21 to hold the front holder 60 in a manner that the retained part 65*b* with a protrusion shape is inserted into the retaining part 65*a* with a groove or hole shape, and the retained part 65*b* and an inner wall surface of the retaining part 65*a* are disposed so as to be retained in the range of the allowable relative movement quantity. In view of this, in this holding mechanism 65, the retaining part 65*a* as the groove or the penetration hole that can have the retained part 65*b* inserted and retained is formed on the outer peripheral wall surface 21*a* of the engagement part 21. This retaining part 65*a* is formed to have a shape that can retain the inserted retained part 65*b* on the inserting direction side and retain the movement of the retained part 65*b* to the inserting direction side. In this holding mechanism 65, the retained part 65*b* is formed to have a shape that projects to the outer peripheral wall surface 21*a* of the engagement part 21 and that can be inserted into and retained by the retaining part 65*a* that is the groove or the penetration hole. The retaining part 65*a* in this example is formed to have a rectangular shape including a side part extending along the inserting and removing direction and a side part extending along the circumferential direction. The retained part 65*b* in this example is formed as a claw part that is retained by an inner peripheral wall surface of the retaining part 65*a* (the inner peripheral wall surface of the side part on the inserting direction side along the circumferential direction).

The first tubular part 61 illustrated here includes a piece part 65*c* with flexibility and a cantilever shape extending in the tube axis direction and being flexible at least in a direction of separating from the outer peripheral wall surface 21*a* of the engagement part 21 (FIG. 3 and FIG. 6). The retained part 65*b* projects from a free end of the piece part 65*c* to the outer peripheral wall surface 21*a* side. Therefore, in the holding mechanism 65 illustrated here, when the engagement part 21 is inserted into the first tubular part 61, the retained part 65*b* is pushed by the outer peripheral wall surface 21*a* of the engagement part 21 so that the piece part 65*c* is bent in a direction of separating from the outer peripheral wall surface 21*a*. In the holding mechanism 65 illustrated here, when the engagement part 21 is inserted further and the retained part 65*b* reaches the retaining part 65*a*, the retained part 65*b* is inserted into the retaining part 65*a* while the bending of the piece part 65*c* is cancelled.

Such holding mechanisms 65 between the first tubular part 61 and the engagement part 21 are provided at a plurality of places along the circumferential direction of the outer peripheral wall surface 21*a* of the engagement part 21 and the first tubular part 61. In this example, the holding mechanisms 65 are provided at four places. Here, between the first tubular part 61 and the outer peripheral wall surface 21*a* of the engagement part 21, two holding mechanisms 65 are provided at each of the portions facing each other in the direction orthogonal to the inserting direction and the direction where the three terminal fittings 10 are arranged.

A second tubular part 62 projects to the inserting direction side over the opposing wall parts 63*a* and 63*b* between the opposing wall parts 63*a* and 63*b* at one end of the first tubular part 61 in the tube axis direction. This second tubular part 62 houses the terminal connection part 11 together with the projection part 22 on the inside, and makes the end part of the terminal connection part 11 on the penetration hole 11*a* side project from the inside.

In the front holder 60 illustrated here, an opening at the other end of the first tubular part 61 in the tube axis direction is used as the insertion port 60*a*. In the front holder 60 illustrated here, a part of the engagement part 21 on the removing direction side projects from the insertion port 60*a*. Therefore, in this front holder 60, an annular end surface of the first tubular part 61 on the insertion port 60*a* side is disposed to face an annular end surface of the tubular part 24 of the housing 20 with a space therebetween in the inserting and removing direction. In this connector 1, between the annular end surface of the first tubular part 61 on the insertion port 60*a* side and the annular end surface of the tubular part 24 of the housing 20, an annular groove whose groove bottom is the outer peripheral wall surface 21*a* of the engagement part 21 is formed. In this connector 1, an annular water-stopping member 44 is provided to the annular groove (FIG. 1 to FIG. 8).

The water-stopping member 44 is molded of a synthetic resin material that is elastically deformable, such as rubber. This water-stopping member 44 includes a tubular base part 44*a*, annular lips 44*b* with the same axis projecting from an inner peripheral surface of this base part 44*a* (hereinafter referred to as "inner peripheral lips"), and annular lips 44*c* with the same axis projecting from an outer peripheral surface of this base part 44*a* (hereinafter referred to as "outer peripheral lips") (FIG. 6 and FIG. 8). In this water-stopping member 44, the inner peripheral lips 44*b* and the outer peripheral lips 44*c* are arranged in the tube axis direction of the base part 44*a*. The water-stopping member 44 illustrated here includes two inner peripheral lips 44*b* and two outer peripheral lips 44*c*. The base part 44*a* illustrated here is formed so that the cross-section thereof orthogonal to the tube axis has an elliptical tubular shape. Then, the inner peripheral lips 44*b* and the outer peripheral lips 44*c* illustrated here are formed so that the cross-sections thereof orthogonal to the tube axis of the base part 44*a* each have an elliptical annular shape.

This water-stopping member 44 has the inner peripheral side assembled to a projection part 21$a_1$ from the insertion port 60*a* of the front holder 60 on the outer peripheral wall surface 21*a* of the engagement part 21 (FIG. 3). This water-stopping member 44, when assembled to the projection part 21$a_1$, has the inner peripheral lips 44*b* on the inner peripheral side elastically deformed so that the inner peripheral lips 44*b* are in close contact with the projection part 21$a_1$. When the engagement part 21 and the counterpart engagement part 521 are in the inserted and engaged state, the water-stopping member 44 elastically deforms the outer peripheral lips 44*c* on the outer peripheral side so that the outer peripheral lips 44*c* are in close contact with the inner peripheral wall surface 521*a* of the counterpart engagement part 521. The water-stopping member 44 closes the annular space between the projection part 21$a_1$ of the outer peripheral wall surface 21*a* and the inner peripheral wall surface 521*a* of the counterpart engagement part 521 in this manner, so that the entry of liquid such as water into the casing 501 from between the engagement part 21 and the counterpart engagement part 521 is prevented.

In the water-stopping member 44 illustrated here, the base part 44*a* projects over the inner peripheral lips 44*b* and the outer peripheral lips 44*c* on one side in the tube axis direction (FIG. 4). Here, a projection part 44$a_1$ of the base part 44*a* is disposed on the first tubular part 61 side of the front holder 60. The first tubular part 61 covers an outer peripheral surface of an end part of the projection part 44$a_1$ on the inserting direction side. That is to say, the end part of the first tubular part 61 on the insertion port 60*a* side has a flipping suppressing function for suppressing the flipping of the base part 44*a*, for example.

This water-stopping member 44 is positioned by the housing 20 and the front holder 60 on the tube axis with respect to the engagement part 21. A positioning mechanism 45 in the tube axis direction (hereinafter referred to as "first positioning mechanism") includes a first retaining part 45*a* using the tubular part 24, a second retaining part 45*b* provided to the first tubular part 61 of the front holder 60, a first retained part 45*c* using the other end surface of the base part 44*a* in the tube axis direction, and a second retained part 45*d* using one end surface of the base part 44*a* in the tube axis direction (end surface of projection part 44$a_1$) (FIG. 4). In this first positioning mechanism 45, the first retaining part 45*a* and the first retained part 45*c* are disposed to face each other in the tube axis direction, and the second retaining part 45*b* and the second retained part 45*d* are disposed to face each other in the tube axis direction. The first positioning mechanism 45 is set so that the total value of the distance between a pair of the first retaining part 45*a* and the first retained part 45*c* in the tube axis direction and the distance between a pair of the second retaining part 45*b* and the second retained part 45*d* in the tube axis direction is within the range of the allowable relative movement quantity in design in the tube axis direction of the water-stopping member 44 with respect to the engagement part 21. The allowable relative movement quantity is determined in consideration of tolerance variation or the like of the housing 20, the front holder 60, and the water-stopping member 44. Thus, the first positioning mechanism 45 keeps the position of the water-stopping member 44 on the tube axis with respect to the engagement part 21 the position in the defined range in the design.

This water-stopping member 44 includes a positioning mechanism 46 (hereinafter referred to as "second positioning mechanism") for positioning the engagement part 21 in a circumferential direction between the water-stopping member 44 and the engagement part 21 (FIG. 2, FIG. 3, and FIG. 6). In other words, this second positioning mechanism 46 can be regarded as a rotation stopping mechanism that prevents the relative movement in the circumferential direction of the water-stopping member 44 with respect to the engagement part 21. In this second positioning mechanism 46, a retaining part 46*a* provided to the engagement part 21 and a retained part 46*b* provided to the water-stopping member 44 are disposed so as to be retained together in the range of the allowable relative movement quantity in design in the circumferential direction. The allowable relative movement quantity is determined in consideration of the tolerance variation or the like of the housing 20 and the water-stopping member 44. Thus, the second positioning mechanism 46 retains the relative movement between the engagement part 21 and the water-stopping member 44 in the circumferential direction in the range of the allowable relative movement quantity, and keeps the position of the water-stopping member 44 in the circumferential direction with respect to the engagement part 21 the position in the defined range in the design.

This second positioning mechanism 46 is to retain the relative movement between the engagement part 21 and the water-stopping member 44 in the circumferential direction in a manner that the retained part 46*b* with a projection shape is inserted into the retaining part 46*a* with a groove or hole shape, and the retained part 46*b* and an inner wall surface of the retaining part 46*a* are disposed so as to be retained in the range of the allowable relative movement quantity. In view of this, in the second positioning mechanism 46, the retaining part 46*a* as the groove or the penetration hole that can have the retained part 46*b* inserted and retained is formed on the outer peripheral wall surface 21*a* of the engagement part 21. This retaining part 46*a* is formed to have a shape that can retain the inserted retained part 46*b* with one inner peripheral wall surface and the other inner peripheral wall surface in the circumferential direction and retain the movement of the retained part 46*b* in the circumferential direction. In this second positioning mechanism 46, the retained part 46*b* is formed to have a shape that projects inward relative to the inner peripheral surface of the water-stopping member 44, and that can be inserted into and retained by the retaining part 46*a* that is the groove or the penetration hole. This retained part 46*b* projects over a top of the inner peripheral lip 44*b*. The retaining part 46*a* in this example is formed to have a rectangular shape including a side part extending along the inserting and removing direction and a side part extending along the circumferential direction. The retained part 46*b* in this example is formed as a piece part that is retained by an inner peripheral wall surface of the retaining part 46*a* (the inner peripheral wall surface of the side part along the inserting and removing direction). Here, the retained part 46*b* is formed to have a rectangular piece body shape having a plane orthogonal to the tube axis direction. Note that the retaining part 46*a* may retain the inserted retained part 46*b* on the removing direction side.

Such second positioning mechanisms 46 between the engagement part 21 and the water-stopping member 44 are provided at a plurality of places along the circumferential direction of the water-stopping member 44 and the outer peripheral wall surface 21*a* of the engagement part 21. In this example, the second positioning mechanisms 46 are provided at four places. Here, between the water-stopping member 44 and the outer peripheral wall surface 21*a* of the engagement part 21, the two second positioning mechanisms 46 are provided at each of the portions facing each other in the direction orthogonal to the inserting direction and to the direction where the three terminal fittings 10 are arranged.

Here, this connector 1 includes the same number of holding mechanisms 65 and second positioning mechanisms 46, and a pair of the holding mechanism 65 and the second positioning mechanism 46 is provided adjacent to another pair. In the pair of the holding mechanism 65 and the second positioning mechanism 46, the retaining part (hereinafter referred to as "first retaining part") 65*a* of the holding mechanism 65 and the retaining part (hereinafter referred to as "second retaining part") 46*a* of the second positioning mechanism 46 are formed as one portion in a communicating state. That is to say, the engagement part 21 includes a retaining part (hereinafter referred to as "communication retaining part") 21*d* where the first retaining part 65*a* and the second retaining part 46*a* are provided in the communicating state for each combination of the holding mechanism 65 and the second positioning mechanism 46 (FIG. 3 and FIG. 6 to FIG. 8). Therefore, in this connector 1, the combinations of the communication retaining parts 21*d*, the retained parts 46*b* of the water-stopping member 44, and the retained parts 65*b* of the front holder 60 that are disposed so as to be retained are provided at a plurality of places (here, four places) along the circumferential direction.

In this communication retaining part 21*d*, the first retaining part 65*a* and the second retaining part 46*a* are arranged in the inserting and removing direction (the tube axis direction of the engagement part 21). Here, the first retaining part 65*a* is disposed on the inserting direction side and the second retaining part 46*a* is disposed on the removing direction side. The communication retaining part 21*d* is the groove or the penetration hole formed at the outer peripheral wall surface 21*a* of the engagement part 21. Here, the first retaining part 65*a* with the rectangular penetration hole shape and the second retaining part 46*a* with the rectangular penetration hole shape are formed as the penetration holes that connect in the inserting and removing direction.

As described above, in the connector 1 according to the present embodiment, the first retaining part 65*a* for the retained part 65*b* of the front holder 60 and the second retaining part 46*a* for the retained part 46*b* of the water-stopping member 44 are provided to one communication retaining part 21*d*. On the other hand, in the conventional connector, the combination of the first retaining part and the retained part for the front holder and the combination of the second retaining part and the retained part for the water-stopping member are disposed at different places. Thus, in comparison to the conventional connector, the connector 1 according to the present embodiment can suppress the enlargement of the housing or the front holder 60, for example, and accordingly, the enlargement of the whole body can be suppressed. The connector 1 according to the present embodiment suppresses the enlargement of the housing or the front holder 60 in comparison to the conventional connector; thus, the increase in use quantity of the raw material used in the molding of these components can be prevented and the increase in cost can be prevented.

In the connector according to the present embodiment, the first retaining part for the retained part of the front holder and the second retaining part for the retained part of the water-stopping member are provided to one communication retaining part. On the other hand, in the conventional connector, the combination of the first retaining part and the retained part for the front holder and the second retaining part and the retained part for the water-stopping member are disposed at different places. Therefore, in comparison to the conventional connector, the connector according to the present invention can suppress the enlargement of the housing or the front holder, for example, and accordingly, the enlargement of the whole body can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting attached to a terminal of an electric wire;

a housing that houses the terminal fitting on an inner side and includes an engagement part that is inserted into and engaged with an inside of a counterpart engagement part having an inner peripheral wall surface;

a front holder to which the engagement part is inserted along an inserting direction of the engagement part with respect to the counterpart engagement part, and that keeps the terminal fitting held in the housing; and a water-stopping member with an annular shape, an inner peripheral surface side of the water-stopping member being assembled to a projection part from the front holder at an outer peripheral wall surface of the engagement part, the water-stopping member closing an annular space between the projection part of the outer peripheral wall surface and the inner peripheral wall surface of the counterpart engagement part, wherein the front holder includes a retained part that projects toward the outer peripheral wall surface of the engagement part, the water-stopping member includes a retained part that projects inward relative to the inner peripheral surface side, and the engagement part includes a communication retaining part where a first retaining part to which the retained part of the front holder is inserted and that retains movement of the retained part to the inserting direction, and a second retaining part to which the retained part of the water-stopping member is inserted and that retains movement of the retained part in a circumferential direction of the water-stopping member are provided in a communicating state.

2. The connector according to claim 1, wherein the communication retaining part is a groove or a penetration hole formed in the outer peripheral wall surface of the engagement part.

3. The connector according to claim 1, wherein combinations of the retained part of the front holder, the retained part of the water-stopping member, and the communication retaining part are provided at a plurality of places along the circumferential direction.

4. The connector according to claim 2, wherein combinations of the retained part of the front holder, the retained part of the water-stopping member, and the communication retaining part are provided at a plurality of places along the circumferential direction.

* * * * *